United States Patent [19]

Westphal et al.

[11] 4,320,625

[45] Mar. 23, 1982

[54] METHOD AND APPARATUS FOR THERMAL STRESS CONTROLLED LOADING OF STEAM TURBINES

[75] Inventors: Bernd A. K. Westphal, Scotia, N.Y.; James H. Moore, Jr., Cape Elizabeth, Me.; Richard G. Livingston, Scotia, N.Y.

[73] Assignee: General Electric Company, Schenectady, N.Y.

[21] Appl. No.: 145,219

[22] Filed: Apr. 30, 1980

[51] Int. Cl.[3] ..... F01K 13/02

[52] U.S. Cl. ..... 60/646; 60/657

[58] Field of Search ..... 60/646, 657, 660; 415/17

[56] References Cited

U.S. PATENT DOCUMENTS

| | | | |
|---|---|---|---|
| 3,446,224 | 5/1969 | Zwicky, Jr. . | |
| 3,561,216 | 2/1971 | Moore, Jr. . | |
| 3,588,265 | 6/1971 | Berry | 415/1 |
| 3,928,972 | 12/1975 | Osborne | 60/646 |
| 4,046,002 | 9/1977 | Murphy et al. | 73/116 |
| 4,120,159 | 10/1978 | Matsumoto et al. | 60/667 |
| 4,121,424 | 10/1978 | Sato et al. | 60/646 |
| 4,181,840 | 1/1980 | Osborne | 290/40 |

*Primary Examiner*—Allen M. Ostrager
*Attorney, Agent, or Firm*—Ormand R. Austin; John F. Ahern

[57] ABSTRACT

Improved method and apparatus for controlling thermal stress on component parts of a steam turbine while providing maximum loading and unloading rates during startup, shutdown, and other periods of load change. From monitored and derived quantities, a loading rate is calculated for each of a plurality of preselected turbine component parts and the lowest rate is selected for control. Simultaneously, and in concert with load change calculation and execution, the steam admission mode of the turbine is automatically directed to either the partial arc mode or the full arc mode as necessary to reduce stress as compared with a preselected and adaptive stress reference value.

13 Claims, 6 Drawing Figures

METHOD AND APPARATUS FOR THERMAL STRESS CONTROLLED LOADING OF STEAM TURBINES

This invention relates to a method and apparatus for rapidly loading and unloading steam turbine-generators to achieve maximum load change rates while simultaneously avoiding excessive thermal stress on turbine component parts.

BACKGROUND OF THE INVENTION

To promote reliability and prolong the operating life of a large steam turbine, it is imperative that excessive thermal stresses be avoided during all operating phases of the turbine. This includes loading and unloading the turbine with respect to a target load. Upon turbine startup, thermal stresses result from a mismatch between the temperature of the admitted steam and the turbine metal temperature. The degree of mismatch and the potential for excessive stress depend on recent operating history and on the point from which startup is begun, i.e., whether the turbine is involved in a hot start or a cold start. Once the turbine is started and producing load, however, steam flow is high enough that surface metal temperature closely follows steam temperature and overstressing can then be caused by rapid, uncontrolled changes in load.

Control of thermal stress is based primarily on analytical and statistical correlation between stress levels and expected rotor life. In the past, charts, graphs, and other control methods have been devised to guide the operator during the acceleration phase of the startup and to determine and control rates of change of metal temperature during the loading procedure. Various techniques have also been employed to speed up the loading process, including periods of heat soaking on "turning gear" to reduce the initial temperature mismatch. In addition, initial operation in the less efficient "full arc" steam admission mode is used to achieve uniform warming of the high pressure turbine inlet parts.

There have been a number of suggestions in the published prior art of methods to start and control steam turbines so that startup time can be minimized without inflicting damage on the turbine. However, these methods are usually predicated on ideal boiler conditions rarely existing in practice. Since turbine startups can take several hours, systems which reduce startup and loading and unloading times while allowing for fluctuations in steam temperature and pressure are of great value.

Sophisticated approaches to startup and loading control by means of continuously calculating rotor surface and bore stresses from speed and temperature measurements, and then loading to a maximum permissible stress are described in U.S. Pat. No. 3,446,224 to E. E. Zwicky, Jr. and in U.S. Pat. No. 3,561,216 to J. H. Moore, Jr., the disclosures of which are incorporated herein by reference thereto. Although these patents disclose methods and apparatus for achieving rapid startup and loading, faster results are desirable and can be expected through better thermal stress distribution among various parts of the different turbine sections relative to their design capabilities. Accordingly, it is among the objects of the present invention to provide an improved method and apparatus for controlling thermal stress on the component parts of a steam turbine while providing maximum loading and unloading rates during startup, shutdown, and other periods of load change.

SUMMARY OF THE INVENTION

In practicing the present invention, resultant stress and the time rate of change of stress, along with the time rate of change of supply steam temperature are monitored for a number of preselected component parts of the turbine. From these monitored and derived quantities a loading rate is calculated for each preselected component part and the lowest rate is then selected to cause a corresponding change in load setting on an associated load control means. Simultaneously, and in concert with the load rate change calculation and execution, the steam admission mode of the turbine is automatically directed to either the partial arc mode or the full arc mode as necessary to minimize stress. For this, a stress reference value is determined from an initially calculated loading rate and a maximum load rate set by an operator. The reference value is summed with the highest value of stress determined for a preselected component of the turbine and a difference value of stress is obtained. The difference value is then applied to an associated admission mode transfer means which directs the steam admission mode to either the full arc mode or the partial arc mode to minimize the difference. In a preferred embodiment, the difference value may be shifted about a nominal value by biasing means and may be multiplied by factors whose value depends upon the time rate of change of stress and the current operating load on the turbine.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
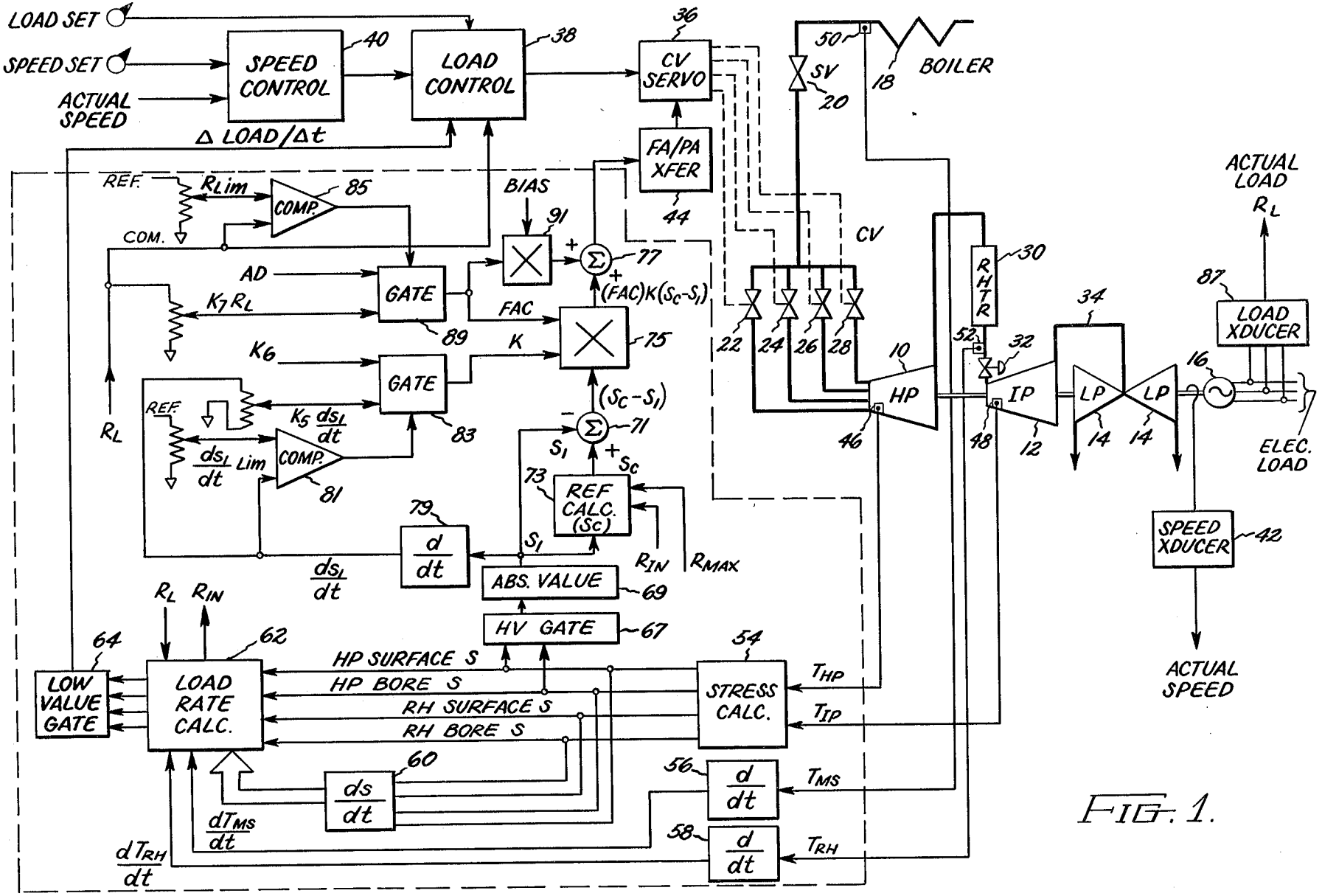
FIG. 1 is a simplified schematic diagram of a control system according to the present invention.

Referring to FIG. 1 of the drawing, a schematic diagram shows, in functional diagrammatic form, portions of a reheat steam turbine, its normal speed and load control system and an automatic stress controlled loading system according to the present invention. It will be understood by those skilled in the art that a large steam turbine-generator control system is very complex and hence only the portions material to the present invention are shown here.

Portions of the turbine shown include a high pressure section 10, reheat section 12 and a double-flow low pressure section 14, all arranged in tandem to drive an electrical generator 16 which supplies electrical power to a load. The number and arrangement of low pressure turbines are not important to an understanding of the invention. Steam flow is from a boiler 18 through main stop valve 20, and then through control valves 22, 24, 26, and 28. Each control valve is connected to a different nozzle arc of the first stage of high pressure section 10. Steam from the high pressure section 10 is reheated in reheater 30, flows through intercept valve 32 to the reheat section 12, and then through crossover conduit 34 to the low pressure section 14.

The admission of steam is controlled through a control valve servomechanism shown collectively as 36 and operatively connected to the respective valves as indicated by dotted lines. The servomechanism may be of the electrohydraulic type driving high pressure hydraulic rams in response to electrical signals as is well known in the art.

The servomechanism 36 is under the control of a load control unit 38 which provides a suitable valve positioning signal corresponding to a desired rate of steam flow. The remainder of the primary control loop includes a speed control unit 40 which receives a speed signal from a shaft speed transducer 42. A control system for speed and load control suitable for use with the present invention is that taught by Eggenberger in U.S. Pat. No. 3,097,488, the disclosure of which is incorporated herein by reference thereto.

As is known to those skilled in the art, control valves 22–28 may be manipulated so as to either admit steam uniformly through all of the nozzle arcs in the "full arc" admission mode, or control valves 22–28 can be manipulated in sequence to admit steam in the thermodynamically more efficient "partial arc" mode of admission. Means to transfer back and forth between the full arc and partial arc mode, as well as to indicate the degree of transfer which has taken place, is shown schematically as a transfer device 44. A method and apparatus effective in this regard is that described in U.S. Pat. No. 4,177,387 to Malone, the disclosure of which is incorporated herein by reference thereto. Another type of transfer mechanism is seen in U.S. Pat. No. 3,403,892 to Eggenberger et al, which disclosure is also incorporated herein by reference thereto.

Shown within the dashed lines of FIG. 1 are automatic mode selection means and load rate control means interactive with the load control unit 38 and with the mode transfer means 44. Automatic mode selection and load rate control apparatus according to FIG. 1 may be implemented with well-known, conventional components. Signals processed by such apparatus may be either analog or digital in nature, or they may be a combination of analog and digital. Furthermore, as more fully disclosed hereinafter, automatic mode selection and load rate control according to the present invention may be carried out with a stored program computer.

Preferably, inputs to the load/mode controller portion of the system, shown within the dashed lines of FIG. 1, include the first stage metal temperature $T_{HP}$ sensed by thermocouple 46, the reheat section metal temperature $T_{IP}$ sensed by thermocouple 48, the main steam temperature $T_{MS}$ sensed by thermocouple 50, and reheat steam temperature $T_{RH}$ sensed by thermocouple 52.

Stress calculator 54 uses the temperature inputs to calculate stress imposed on the surface and bore of the high pressure section rotor and on the surface and bore of the reheat section rotor. If the turbine is assumed to be operating at rated speed, only thermal stresses need be considered and rotor speed is not a necessary input to calculator 54. For calculating such rotor stresses, apparatus, circuitry and methodology applicable to the present invention are fully described in the previously mentioned U.S. Pat. No. 3,446,224.

The time rate of change of steam temperature is determined for the main steam temperature $T_{MS}$ and for the reheat steam temperature $T_{RH}$ respectively, by differentiating means 56 and 58. Also, the time rate of change of turbine stress is determined by differentiator 60. The output signals from stress calculator 54, from steam temperature differentiators 56 and 58, and from stress differentiator 60 are applied to load rate calculator 62. Thus, load rate calculator 62 receives signals representative of stress on four preselected component parts of the turbine, signals representative of the time rate of change of stress for those components, and signals representative of the time rate of change of temperature for steam being supplied to the turbine. Preselected components for a preferred embodiment include the surface and bore of the high pressure rotor and the surface and bore of the reheat rotor. From these input signals the load rate calculator 62 determines a permissible loading rate for each preselected turbine component part. For this calculation, stress values, rates of change of stress, and rates of change of steam temperature are correspondingly matched. For example, loading rate calculated for the high pressure rotor surface is based on the high pressure rotor surface stress, its rate of change, and the rate of change of main steam temperature. The rates of change provides an element of predictability to the calculation. Differentiator means for providing such rates are well known in the electronics and signal processing arts, and may, for example, be electronically configured using operational amplifiers and resistance-capacitance networks.

Each loading rate calculation is made by loading rate calculator 62 according to the following relationship:

$$R=(R_1+R_3)R_2$$

where $$R_1=K_1(K_2-S)$$

$$R_2=1-K_3(dT)/(dt)S^2$$

$$R_3=-K_4dS/dtS^2$$

and $K_1$, $K_2$, $K_3$ and $K_4$ are constants whose values depend on the particular turbine being controlled and its operating parameters, S is stress determined for the corresponding turbine component part, and T is the corresponding steam temperature.

Operative to produce four rates according to this relationship, loading rate calculator 62, may be configured from adders, subtractors, and multiplying devices well known to those of ordinary skill in the art. The four loading rates thus calculated are applied to a low value gate 64 which selects the lowest of the loading rates and applies it to load control unit 38 to effect the loading or unloading rate of the turbine accordingly.

Figure 2A:
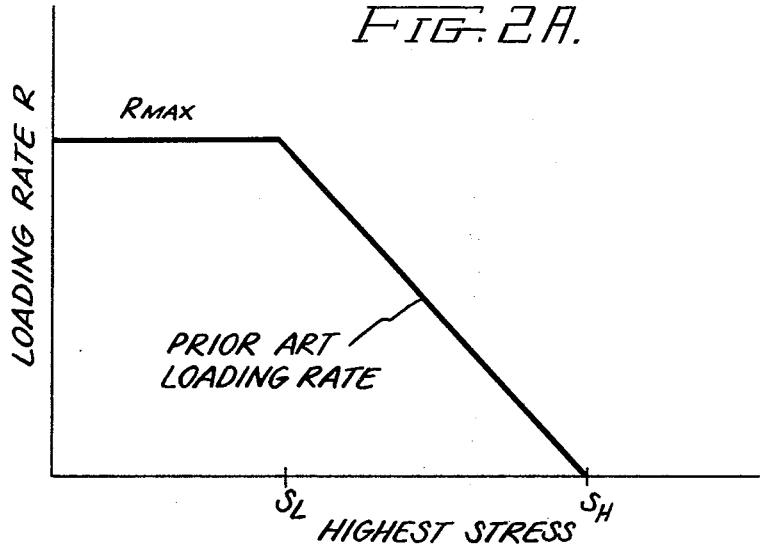
FIG. 2A illustrates the relationship between loading rate and stress for prior art turbine loading control systems.
Figure 2B:
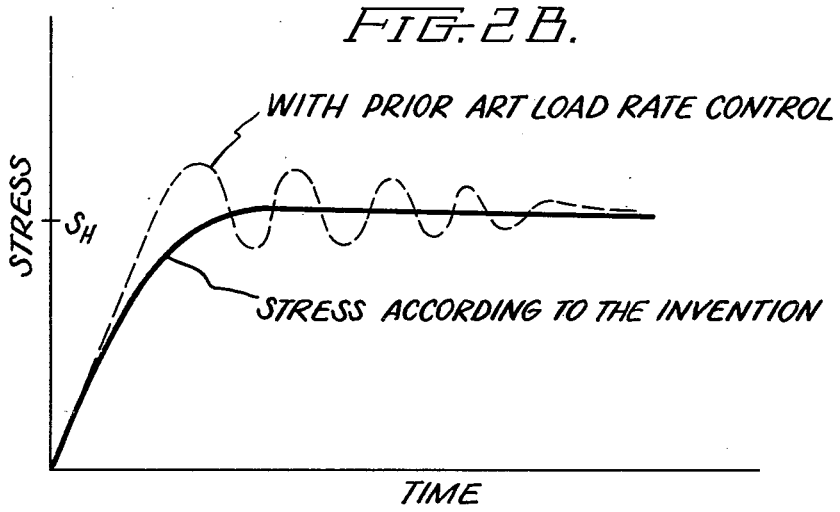
FIGS. 2B and 2C provide a comparison of the resulting effects on stress and load, respectively, for a steam turbine controlled in accord with the relationship of FIGS. 2A and in accord with the present invention.
Figure 2C:
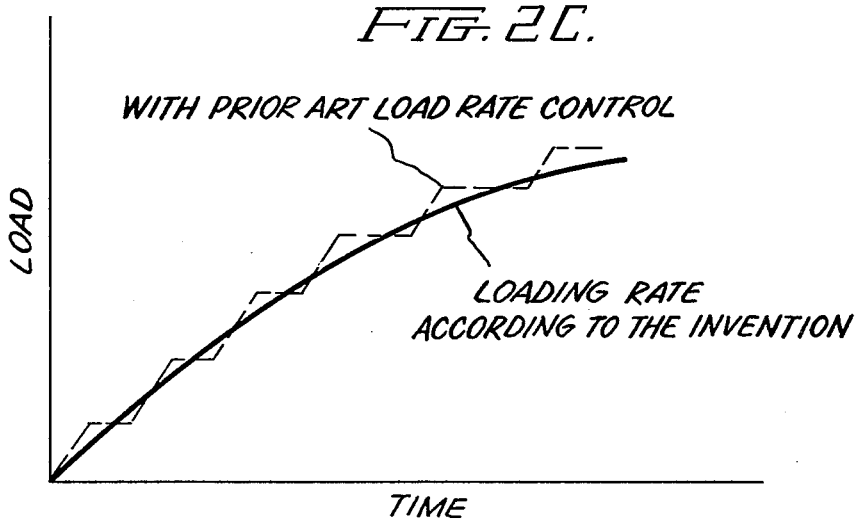

In prior art load rate controllers, such as that exemplified by the aforementioned U.S. Pat. No. 3,561,216 to Moore, Jr., loading rate has been determined as a function of rotor stress as illustrated herein by FIG. 2A. The relationship shown provides proportional control above a certain level of stress $S_L$ and in the stress range between $S_L$ and $S_H$. With low loop again (i.e., the rate of change of R with S is relatively low), steady-state stress during loading is well below $S_H$. However, under conditions of increasing boiler steam temperature and at half load or less, a limit cycle may develop wherein stress cycles around $S_H$ and loading rate cycles between zero and the maximum value $R_{MAX}$ set by an operator. These effects are shown, respectively, in FIGS. 2B and 2C wherein stress and loading rate achieved with the present control system are compared with the results attained with prior art loading rate controllers. With the present invention the loading rate proceeds smoothly to a target load at an acceptable stress level without oscillatory excursions to excessive levels. In FIGS. 2B and 2C, results with prior art controllers are illustrated with broken lines; results with controllers according to the present invention are shown with unbroken lines.

Examination of the relationship set forth above and the three defined factors $R_1$, $R_2$, and $R_3$ indicates that $R_1$ is a linear function of stress, declining as stress increases. The constants $K_1$ and $K_2$ are selected to provide relatively high values of $R_1$ at low stress levels and to provide relatively low gain, i.e., $R_1$ declines relatively slowly as stress increases. Factors $R_2$ and $R_3$ are designed to have little effect on the calculated rate R at low values of stress but are effective to take hold quickly as stress increases. Hence, the inclusion of the squared value of stress in each factor. The factors $R_2$ and $R_3$ include, respectively, rate determinations dT/dt and dS/dt to provide elements of predictability to the calculated loading rate. The constant values $K_1$, $K_2$, $K_3$, and $K_4$ are functions of particular turbine geometry and design, but, by way of example, with $K_1=8.3$, $K_2=0.9$, $K_3=0.1$, and $K_4=60$, loading rates consistent with the objectives of the invention have been realized. It will be recognized, of course, that $K_1$, $K_2$, $K_3$, and $K_4$ may be preadjustable in loading rate calculator 62.

By convention, stresses resulting from an increasing temperature are calculated as positive quantities, and stresses due to a decreasing temperature are calculated as negative. The convention is carried through in determining the time rate of change of stress and of time rate of change of steam temperature. These polarities are properly accounted for in determining either a positive or negative loading rate in loading rate calculator 62 to either cause a loading or unloading of the turbine as is appropriate.

The foregoing has described a method of controlling a load change rate for a steam turbine which, of itself, provides loading and unloading rates by which the turbine can attain a target load without the infliction of damaging stresses upon components of the turbine. However, consistent with the objectives of the invention, means are also provided whereby the loading or unloading rate actually imposed upon the turbine is an optimal rate; that is, it is the maximum or fastest rate permissible without producing excessive stress. This is achieved by controlling the steam admission mode simultaneously with control of the load change rate. Total coordinated control is predicated upon the following actions and responses.

1. In accord with previously described features of the invention, loading rate is determined by the most positive of the high pressure and reheat rotor stresses subject to a maximum rate set by an operator. Conversely, unloading rate is determined by the most negative of the high pressure and reheat rotor stresses.
2. At less than full load, temperature of the first stage of the high pressure section is decreased by adjusting the admission mode toward partial arc and is increased by adjusting the admission mode toward full arc.
3. With high pressure rotor stress limiting the loading rate, the admission mode is adjusted toward partial arc to allow an increase in the loading rate to that permitted by reheat rotor stress or the operator set limit. During unloading, if the high pressure rotor stress is limiting, the admission mode is adjusted toward full arc to increase the unloading rate to that permitted by reheat rotor stress.
4. When the reheat rotor stress is limiting the loading rate, the admission mode is adjusted toward full arc to continue heating the high pressure rotor as necessary and to keep the stress thereon at the maximum permissible level that will not affect loading. Alternatively, if the reheat rotor stress is limiting unloading, the admission mode is adjusted toward partial arc for cooling of the high pressure rotor and again to keep the stress at the maximum permissible level that will not affect the unloading rate.

Referring again to FIG. 1, the admission mode control portion of the system will now be described. The higher of the surface or bore stress for the high pressure rotor is first selected by high value gate 67 and the absolute value of the selected stress is then provided by absolute value device 69. The absolute value of stress, labeled S1, is summed against a reference value of stress $S_C$ at summing junction 71. The reference value of stress $S_C$ is calculated in reference calculator 73 and is a function of an initial loading rate $R_{IN}$ or an operator selected maximum loading rate $R_{MAX}$, depending upon the magnitude of stress $S_1$. The calculation of $S_C$ may be implemented with conventional analog or digital components according to the formula and conditions set forth in FIG. 3 and as hereinafter described. The initial loading rate $R_{IN}$ is stress independent and is determined by loading rate calculator 62 for controlling the turbine during very early turbine startup periods before actual values of stress have risen to a level of which they are meaningfully applied in a load rate calculation. The initial loading rate $R_{IN}$ constitutes a loading rate which the turbine would be able to sustain over the entire loading range with a conservative safety margin. Appropriate method of calculating an initial loading rate include those of long standing use in the art, but preferably the calculation is based on anticipated temperature changes in the high pressure section of the turbine. It will be recognized that neither the precise magnitude of the initial loading rate nor its method of calculation are elements of the present invention.

Operative according to the invention, the steam admission mode of the turbine is automatically directed, by virtue of full arc to partial arc transfer means 44, to that mode of operation which causes the difference (produced by summing junction 71) between the reference value of stress $S_C$ and the actual value of stress $S_1$ to be minimized. It will be recognized, of course, that in minimizing the difference, the admission mode may be controlled at a point which is intermediate to extreme positions of partial arc or full arc operation. In any case, it is desirable that the difference signal ($S_C$–$S_1$) be amplified by an amount depending on present operating conditions of the turbine and the rate of change of stress, and that a manual means be provided to adjust the equilibrium point between full arc and partial arc about which the difference signal is minimized. Accordingly, the difference signal ($S_C$–$S_1$) is multiplied by factors K and FAC in first multiplier unit 75. The product of the multiplication is then summed against a bias signal in summing junction 77. The magnitude of factor K depends upon the rate of change of the selected high value of stress $dS_1/dt$ with the required rate function being provided by differentiator 79. Comparator 81 activates gate 83 to select either $K_6$ or $K_5 dS_1/dt$ as the multiplication factor K depending upon whether the rate of change of stress $dS_1/dt$ is higher or lower than a preselected limit value of $dS_1/dt$.

In comparator 85 the present actual load $R_L$ on the turbine (determined by load transducer 87) is compared with a preset limit value $R_{LIM}$ and actuates gate 89 to select either $K_7$ $R_L$ or AD as the second multiplying factor FAC depending on whether the current operating load is higher or lower than the preselected value $R_{LIM}$. The selected value of FAC is applied to first multiplier 75 and to a second multiplier 91 wherein it is multiplied against a preselected bias value before finally being summed against the multiplied difference signal in summing junction 77. A signal to effect a mode transfer, as has been described, is obtained from summing junction 77 and applied to a mode transfer unit 44.

The control system of FIG. 1 may be realized with readily available and conventional component parts. For example, gates 83 and 89 may be electromechanical or solid state electronic switching devices; comparators 81 and 85, multipliers 75 and 91, reference calculator 73, along with absolute value means 69 and high value gate 67 may be implemented with operational amplifiers in well-known circuit configurations. However, it is to be noted that the controller of FIG. 1 may well be carried out with other than electronic means; such other means include hydraulic, pneumatic, and fluidic apparatus.

Thus the embodiment of FIG. 1 provides continuous automatic control of steam admission mode and load rate control so that turbine operations are optimized under controlled stress conditions. It will be recognized that additional control elements may be utilized in conjunction with the present invention to cause turbine operation in only one or the other of the steam admission modes. For example, at less than ten percent of rated load, it will be recognized as most judicious to maintain turbine operation in the full arc mode. In maintaining higher constant loads, on the other hand, control may always be directed to the more efficient partial arc mode of steam admission.

Thermal stress controlled loading or unloading of a steam turbine according to the present invention can be carried out in a system as illustrated in FIG. 1 and as described above, or, alternatively, a stored program digital computer can be utilized to interact with load control and mode transfer means (such as, for example, load control unit 38 and transfer unit 44 of FIG. 1) to carry out the invention. A dedicated computer-type control system particularly well adapted for load rate and mode control according to the present invention is that disclosed and claimed in U.S. Pat. No. 4,280,060 for "Dedicated Microcomputer Based Control System For Turbine-Generators" and assigned to the present assignee, the disclosure of which application is incorporated herein by reference thereto.

Figure 3:
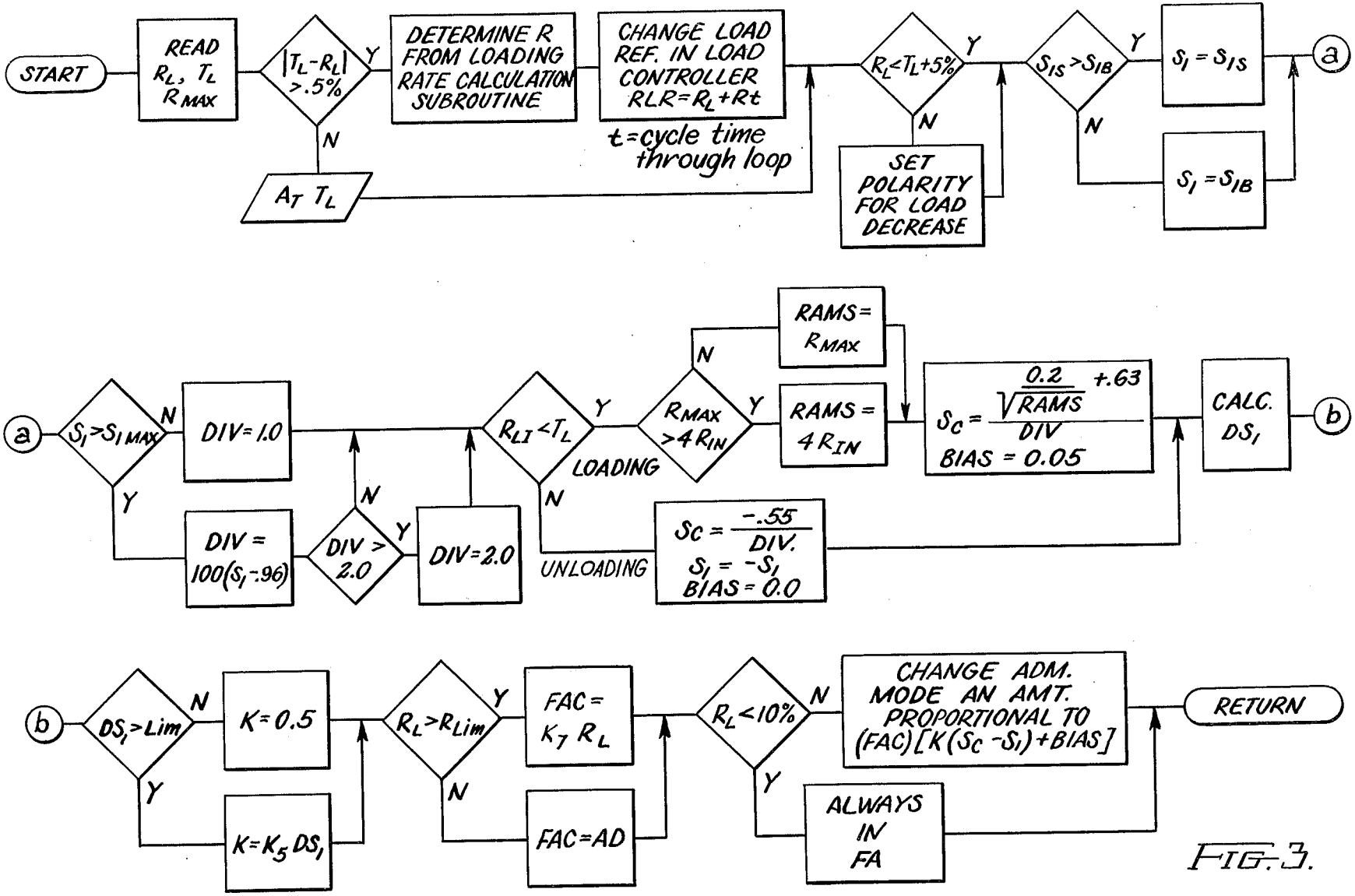
FIG. 3 is a flow chart illustrating loading and admission mode control process steps for implementing the invention with a computer.
Figure 4:
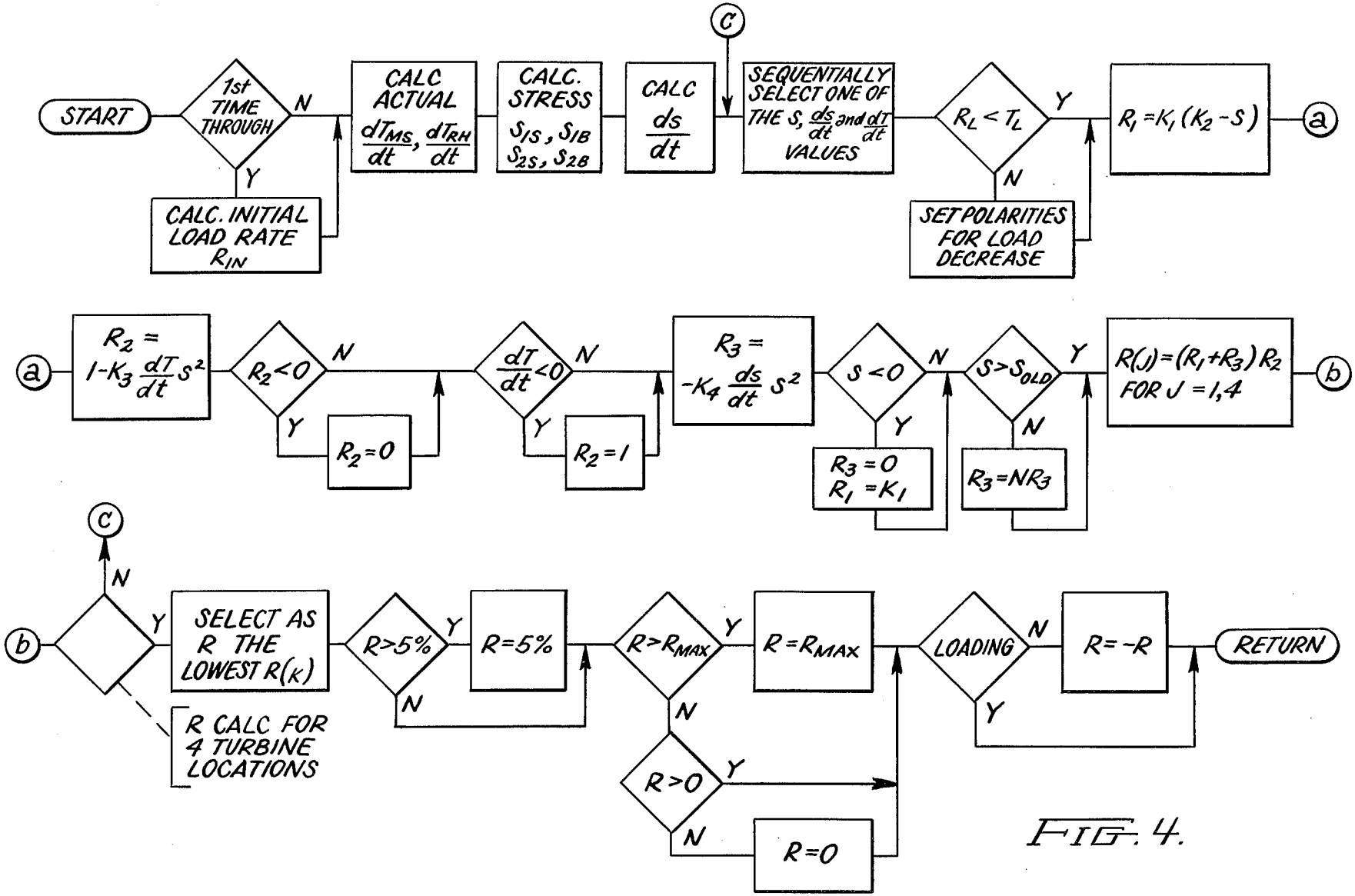
FIG. 4 is a flow chart illustrating load rate calculation steps for implementing that aspect of the invention with a computer.

Illustrated in FIGS. 3 and 4 are flow charts illustrating the procedural steps to follow for programming a computer to accomplish stress controlled loading in accordance with the present invention. With these flow charts and with knowledge of the particular turbine to be controlled (including details of its installation, geometry, and particular usage) so that constant factors related thereto are known, preparation of a programmed set of instructions in accord with the invention is well within the scope of those skilled in the art. Set forth below are definitions for the symbols used in the flow charts and which are intended to be consistent with symbols defined and used in connection with FIGS. 1 and 2.

R=Loading rate, expressed as % rated load/min.

$R_{IN}$=Initial loading rate, independent of present stress, determined for initial phase of turbine startup, expressed as % rated load/min.

$R_L$=Present actual load, expressed as a percent of rated load.

RLR=Load reference, expressed as a percent of rated load.

$R_{MAX}$=Maximum loading rate, operator selected, expressed as % rated load/min.

$R_{LI}$=Load at the beginning of a load change, expressed as a percentage of rated load.

$T_L$=Target load, expressed as a percent of rated load.

S=Stress, expressed in normalized units.

$S_{1S}$=Stress, surface of the high pressure rotor.

$S_{1B}$=Stress, bore of the high pressure rotor.

$S_{2S}$=Stress, surface of the reheat rotor.

$S_{2B}$=Stress, bore of the reheat rotor.

$S_1$=Selected higher value of $S_{1B}$ or $S_{1S}$.

$S_{1MAX}$=Preselected maximum allowable value of $S_1$.

$S_C$=Reference value of stress, a lower stress limit, expressed in normalized units.

T=Temperature t=time

DIV=Factor used in the calculation of stress reference $S_C$.

RAMS=Factor used in the calculation of stress reference $S_C$.

$DS_1$=Time rate of change of stress $S_1$.

K=First multiplication factor.

FAC=Second multiplication factor.

$T_{MS}$=Temperature of the main steam supply.

$T_{RH}$=Temperature of steam supply to the reheat section of the turbine.

$S_{OLD}$=S from the previous calculation cycle.

N=Number of minutes S is less than $S_{OLD}$, N=4 maximum.

$R_{LIM}$,AD,$K_{1-7}$=Constants whose values depend upon characteristics of the particular turbine being controlled.

The flow chart of FIG. 3 illustrates, in somewhat simplified form, steps required of a computer program for load rate and admission mode control according to the invention. The flow chart is simplified only in that certain routine safety checks or operator or equipment imposed holds not essential to an understanding of the invention are eliminated. With reference to the flow chart of FIG. 3, once data related to target load and the present load are known, a first step is to determine whether the present load is sufficiently close to target load to satisfy a preset condition. If not, a load calculation subroutine according to the steps of FIG. 4 is called by the program based on FIG. 3 to provide a loading rate R which is then applied to cause a change in a load reference RLR in a load circuit unit such as that illustrated in FIG. 1. A program according to FIG. 3 includes a step to select either positive or negative polarities of stress and the rate of change thereof as is appropriate for loading or unloading. Steps are included for selecting either the surface or bore stress for the high pressure rotor, depending on which is higher. Based on the selected higher value of stress and its relationship to a maximum value, a first factor DIV is chosen for use in calculating the stress reference value $S_C$. The target load is compared with the load setting at the beginning of a load change ($R_{LI}$) to ascertain whether the turbine is being loaded or unloaded. If unloading, then the stress reference value is selected as shown. On the other hand, if the turbine is being loaded, a second factor RAMS, whose value depends on an initial loading rate $R_{IN}$ (calculated in a subroutine according to FIG. 4 for initial loading) and the maximum loading rate selected by the operator, is chosen for use in calculating $S_C$. Also, a bias value is selected which depends on whether the turbine is being loaded or unloaded.

The difference between the stress reference value $S_C$ and the actual, higher value of stress $S_1$ is multiplied by factors K and FAC. The magnitude of the first factor K is determined by the time rate of change of stress, and the second factor FAC is determined by the present actual load on the turbine and a constant $K_7$ related to the type of turbine in service.

Finally, the admission mode transfer unit is provided with a signal proportional to the relationship shown in the last step of the flow chart to cause a mode adjustment as necessary to optimally control stress in the high pressure section of the turbine.

In a loading rate calculation subprogram according to the flow chart of FIG. 4, it is first necessary to ascertain whether an initial loading rate $R_{IN}$ must be calculated. If so, a separate group of process steps (not illustrated) is necessary to calculate a conservation loading rate, independent of stress, to get the turbine initially loaded. This is necessary since in early portions of the loading phase, stress levels have not risen sufficiently to provide meaningful values useful in a load rate calculation. If, however, the program steps have passed this initial requirement, stress values and the time derivatives thereof for four turbine locations are calculated along with rates of change of steam temperature for both the main steam supply and the reheat steam. Stress calculations and initial stress gating routines are not shown in detail since they are substantially described in the aforesaid patent to Zwicky. The stress values, the rate values, and the steam temperature rates are correspondingly matched according to turbine location, and a load change rate R is then calculated for each such location. This is done sequentially until the required number of rates have been computed. The loading rate calculation includes steps to track the stress trend so that the loading rate calculated with each pass through the cycle of program steps is modified to maintain the stress at high, but not excessive levels, to achieve the most rapid loading rates. Steps are also included to determine whether the turbine is in a loading or unloading regime and to set signed values positive or negative accordingly. Other steps are included to place limitations on the magnitude of factors used to compute the loading rate. The lowest loading rate is then selected as the limiting rate from the four rates which have been computed. If the selected rate satisfies criteria with respect to fixed and operator set limits, the calculated rate is then applied to a loading program according to the steps of FIG. 3 and ultimately applied to a load control means such as that of FIG. 1.

The method herein described can be carried out by a large number of equivalent control systems, either analog or digital in nature using electrical, hydraulic, fluidic or pneumatic systems. Thus, while there has been shown and described what is considered a preferred embodiment of the invention, it is understood that various other modifications may be made therein. It is intended to claim all such modifications which fall within the true spirit and scope of the present invention.

What is claimed is:

1. In a control system for a steam turbine having a high pressure section, at least one lower pressure reheat section, a high pressure rotor, a reheat rotor, and a plurality of valves operable to admit steam to the high pressure section through nozzle arcs, a combination to control thermal stress on component parts of the turbine while simultaneously providing maximum loading and unloading rates during all phases of turbine operation, said combination comprising:

load control means for positioning said valves to admit a desired total steam flow to said turbine;

admission mode transfer means for adjusting the relative openings of said valves;

means for determining the temperature of preselected high pressure section component parts and for preselected reheat section component parts;

means for determining steam temperature at preselected locations;

means for determining thermal stress on each preselected component part as a function of temperature;

means for determining the time rate of change of thermal stress for each preselected turbine part;

means for determining the time rate of change of steam temperature of said preselected locations;

means for calculating a load change rate for each preselected turbine part, said load change being a function of the corresponding thermal stress, the time rate of change of said stress, and the corresponding rate of change of steam temperature;

means for selecting the lowest calculated load change rate and for applying said lowest rate to said load control means to change the turbine load accordingly;

means for calculating a reference value of stress as a function of a preselected initial loading rate; and means for determining the difference between said reference value of stress and thermal stress determined for a preselected high pressure section component part, said difference being applied to said admission mode transfer means to cause said valves to be adjusted to relative openings which minimize said difference.

2. The combination of claim 1 wherein said means for determining thermal stress provides stress determinations for the high pressure rotor surface, the high pressure rotor bore, the reheat rotor surface, and the reheat rotor bore.

3. The combination of claim 1 wherein said high pressure section component parts comprise the high pressure rotor surface and the high pressure rotor bore, and said reheat section component parts comprise the reheat rotor surface and the reheat rotor bore.

4. The combination of claims 2 or 3 further including means to select the higher of high pressure rotor surface stress and high pressure rotor bore stress, the selected higher stress being applied to said difference determining means as said stress determined for a preselected high pressure component part.

5. The combination of claim 4 further including:

means for multiplying said difference between said reference value of stress and said selected higher stress by first and second multiplier factors;

means for preselecting said first multiplier factor as a function of the time rate of change of said selected higher stress; and means for preselecting said second multiplier factor as a function of actual loading of said turbine.

6. The combination of claim 5 further including means to selectively bias said difference to allow variation in said difference about a nominal value thereof.

7. The combination of claim 6 wherein said means for calculating a reference value of stress includes a maximum loading rate input, said reference value being calculated as a function of said input and said initial loading rate.

8. For a reheat steam turbine having a high pressure section, a reheat section, a high pressure rotor, a reheat rotor and a plurality of valves arranged in nozzle arcs adapted to admit total steam flow to said high pressure section in a partial arc mode and in a full arc mode, a method for controlling thermal stress on component parts of the turbine during all operating phases including loading and unloading to attain a target load, comprising the steps of:

(a) determining thermal stress resultant on a plurality of turbine component parts;

(b) determining the time rate of change of temperature for steam being supplied to the turbine;

(c) determining the time rate of change of thermal stress on said turbine component parts;

(d) determining a load change rate for each turbine component part for which thermal stress and its time rate of change have been determined, said load change rate being determined as a function of the correspondingly determined stress, the time rate of change of stress, and the time rate of change of steam temperature;

(e) selecting the lowest load change rate and applying said rate to a turbine load controller to effect the selected change in load;

(f) determining a stress reference value which is a function of an initially determined loading rate; and (g) adjusting an admission mode transfer means so as to select a steam admission mode that minimizes the difference between said stress reference value and stress as determined on a preselected one of said plurality of turbine component parts.

9. The method of claim 8 wherein steps (a) through (g) are continuously repeated to provide continuous control of said load change rate in attaining said target load and to provide continuous control of said steam admission mode.

10. The method of claims 8 or 9 wherein each said load change rate is determined according to the formula:

$$R=(R_1+R_3)R_2$$

where $$R_1=K_1(K_2-S)$$

$$R_2=1-K_3dT/dtS^2$$

$$R_3=-K_4dS/dtS^2$$

$$R_3=-K_4dS/dtS^2$$

and $K_1$, $K_2$, $K_3$, and $K_4$ are constants related to turbine parameters, S is stress determined for the corresponding turbine component part, and T is steam temperature.

11. The method of claim 10 wherein said plurality of turbine component parts for which thermal stress is determined comprises the surface and bore of said high pressure rotor; and said admission mode transfer means is adjusted so as to minimize the difference between said stress reference value and the higher of said high pressure rotor bore stress and said high pressure rotor surface stress.

12. The method of claim 10 further including the step of multiplying said difference between said stress reference value and said higher stress by first and second factors, said first factor being a function of the time rate of change of said higher stress, and said second factor being a function of turbine actual load.

13. The method of claim 11 wherein said stress reference value is a function of said initially determined loading rate and of a preselected maximum loading rate.

* * * * *